United States Patent [19]

Slenker

[11] 4,127,836

[45] Nov. 28, 1978

[54] TUNABLE INDUCTOR COIL

[75] Inventor: Stephen Slenker, Chelmsford, Mass.

[73] Assignee: Piconics, Incorporated, Tyngsboro, Mass.

[21] Appl. No.: 864,684

[22] Filed: Dec. 27, 1977

[51] Int. Cl.[2] ..... H01F 21/06

[52] U.S. Cl. ..... 336/136; 85/DIG. 2; 85/32 V; 138/178; 264/156; 428/36; 428/132

[58] Field of Search ..... 264/155, 156; 85/DIG. 2, 32 V, 36; 138/118, 125, 178; 241/278 A, 273.1, 273.3, 273.4; 428/132, 36; 336/130, 136

[56] References Cited

U.S. PATENT DOCUMENTS

| | | | |
|---|---|---|---|
| 2,580,661 | 1/1952 | Daniels | 336/136 |
| 2,584,723 | 2/1952 | Mackey | 336/136 |
| 2,648,031 | 8/1953 | Lang et al. | 336/136 X |
| 3,753,352 | 8/1973 | McNally | 138/178 X |
| 4,010,298 | 3/1977 | Angle | 264/155 X |

*Primary Examiner*—Thomas J. Kozma
*Attorney, Agent, or Firm*—Wolf, Greenfield & Sacks

[57] ABSTRACT

A tunable inductor formed with a hard plastic tubular member having a low coefficient of friction. A length of wire is conventionally coiled about the outer surface of the tube or tubular member. A threaded tuning element is positioned in the tubular member. Holes formed in the wall of the tubular member each define a permanently deformed segment of the wall, with the segments projecting inwardly a distance sufficient to engage the threads of the tuning element. The thread engaging segments function as threads to engage and secure the tuning element. The holes in the wall of the tubular member are preferably filled with an epoxy plastic or the like. In a modification the tubular member is formed with deforming holes and preferably filled with cement to function as a strip proof or strip resistant nut.

5 Claims, 3 Drawing Figures

TUNABLE INDUCTOR COIL

BACKGROUND OF INVENTION

Miniature inductors and transformers have recently been developed using very thin wall plastic tubes, in the order of 0.001 to 0.010 inches in thickness. Such tubes are made of extremely slippery plastic material having a low coefficient of friction. Such materials include, for example, various polyesters, polyamides, polyethylene terephthalate, fluorinated hydrocarbons and others plastics sold under such trademarks, for example, as Mylar, Teflon, Aramid and Kapton. Such plastics are used because their physical and electrical characteristics are ideal for use as thin walled dielectric tubes. Thin wall tubes permit the tuning element to be positioned close to the coil winding for improved inductance characteristics. Many of these plastics have such low coefficients of friction that it has been impossible to provide satisfactory means for securing a tuning element in the tube at variable selected locations. Normally the tuning element is a threaded element which screws into and out of the tube for tuning purposes. Unfortunately, no satisfactory means have been developed to provide internal threads on the inner surface of tubes formed of such plastics for the purpose of adjustably securing the tuning element within it. Some attempts have been made to crimp, dimple or form the thin wall tube with appropriate surface projections on the inner surface. This is difficult because these plastics have extreme memory properties or high coefficients of elasticity. Consequently it has not been possible to permanently form satisfactory dimples, crimps or other shapes on the inner surface of these thin wall tubes. Attempts have also been made to provide suitable threading surfaces on the inside of these tubes by lining the tubes with paper or plastic. Using such liners increases the wall thickness of the tube, thereby decreasing tuning efficiency. Other attempts have been made to provide a tube with a self threading screw surface. However, the plastic material is so hard that it cannot readily be scored by self threading tuning screws. Thus miniature inductors and transformers using ultra thin wall tubes have not been made, heretofore, on commercial scales with any degree of success.

SUBJECT MATTER OF INVENTION

The present invention provides an improved tunable inductor or the like comprising an elongated tubular member arranged with a suitable coil or coils about its outer surface and adapted to receive a threaded tuning element that extends lengthwise into the tubular member. The tubular member is formed of a suitable dielectric plastic material of hard, highly resilient plastic having a high coefficient of elasticity. Means for engaging the threads or the tuning element are formed on the inner wall of the tubular member by holes extending through the wall of the tubular member providing inwardly projecting deforming segments which project into engagement with the threads of the tuning element. In a preferred embodiment of the invention a resin, preferably epoxy, fills the holes and provides additional resistance to rotational movement of threaded tuning elements when torque is applied.

In a modification of the invention, thin wall tubes of hard plastic with a high coefficient of elasticity are permanently deformed, as described above, and filled with an epoxy. Such tubes may serve as strip-proof nuts.

An object of the present invention is to provide an improved means of securing threaded members and in particular an improved means of securing threaded members in thin walled tubes.

A further object of the present invention is to provide an improved electrical transducer having a thin wall dielectric and an adjustable component adjacent to it.

It is also an object of the present invention to provide an improved thin wall miniature tunable inductor.

A still further object of this invention is to make tunable inductors having improved tuning efficiencies by using thin wall dielectric tubes in the order of 0.001 to 0.010 inches in thickness to isolate the tuning element from the coil. Inductors with tubes of this thickness permit the close placement of the tuning element to the coils thereby significantly increasing the efficiency of the inductors.

DETAILED DESCRIPTIONS

The foregoing objects and advantages of the present invention will be more fully understood when considered in conjunction with the accompanying drawings, in which.

DETAILED DESCRIPTION OF INVENTION

Figure 1:
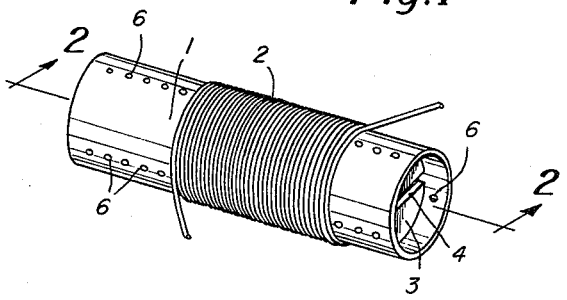
FIG. 1 is a perspective view of a tunable inductor coil embodying the present invention in greatly enlarged scale.

Referring to FIG. 1 there is illustrated a tunable inductor embodying the present invention. Such tunable inductors are used for a wide range of electronic applications including, for example, use in electronic communication circuitry such as paging receivers and the like. Such inductors are normally used to tune to a particular frequency within a selected range and may, for example, be used for selectively setting different communication receivers to specifically different frequency ranges.

Because of the nature of the equipment for which such inductors are used, it is desirable to provide an inductor which has as wide a tuning range as possible. The tuning range of such devices depends in part upon the space between the tuning element and the helically wound wire coils. In tunable inductors presently in use, this distance is dependent upon the tubular member which is used to support the helical coil and contain the tuning element. Therefore it is desirable to use tubular elements which are as thin as possible. With increasing use of microelectronic circuits it has also become desirable to make these tunable inductors as small as possible. A substantial market has developed for small or miniature tunable inductors.

Significant efforts to develop appropriate tubes or tubular members for miniature tunable inductors have not been successful because the plastics that have the necessary electrical characteristics as well as sufficient strength and rigidity have deficiencies which have precluded their adoption for mass production of tunable inductors. Specifically, these plastics do not bond well to adhesives and/or have substantial memory properties. Because of these characteristics it has been difficult to provide a thread engaging inner surface on the tubular members. Attempts to crimp or dimple the tubular element on the inner surface to provide thread engaging elements have been unsuccessful. Nor do these plastic materials lend themselves to scoring by self-cutting screws. Therefore tuning elements shaped as self-cutting screws are not useful. Attempts to line the inner surface of the tubular element with a material such as paper or a soft adhesive material or resin to provide a surface in which threads can be formed have also been unsuccessful or unacceptable. In many cases the adhesives do not bond well to the plastic. In all such cases, moreover, the wall thickness of the tube is effectively increased thereby reducing the tuning effectiveness of the tube.

In the present invention there is provided an arrangement which overcomes these problems. As illustrated in FIG. 1, the tunable inductor comprises a tube or tubular member 1 appropriately insulated, conductive wire 2 and a threaded tuning member 3. The tubular member 1 is sized for the particular requirements of the electrical component, but typically may have a length of a quarter of an inch to one inch, an outer diameter of between 0.030 to 0.050 inches and a wall thickness of from 0.010 to 0.001 inches.

Tubular members of the type used in this invention are conventionally formed of plastic film having a thickness of 1 mil and wrapped to form laminations of two or three layers. As formed, these tubular members have a thickness in the order of 2 or 3 mils and are sufficiently rigid to support a helically wound wire 2. The tolerances on tubing so formed are not normally closer than ±0.0015 inches on the inner diameter. Such tunable inductors would normally be used in frequency ranges from 50KHz to 500MHz. The wire coil 2, which is conventionally wound, may have any number of turns but typically has at least a half dozen. As illustrated, the wire coil is helically wrapped about and closely engages the outer surface of the tubular member 1. The wire may have a typical size range of from 0.001 to 0.010 inches in diameter.

The tuning element 3 is formed of an electrically conductive material such as steel or iron and is normally shaped as a screw having a slotted end 4 that is adapted to permit the insertion of a screwdriver for axial movement of the tunable element 3 within the tubular member 1. Axial movement of the tunable element 3 adjusts the specific frequency of the tunable inductor. It is therefore important that axial movement of the tunable element 3 be subject to careful adjustment within the tubular member 1.

Figure 2:
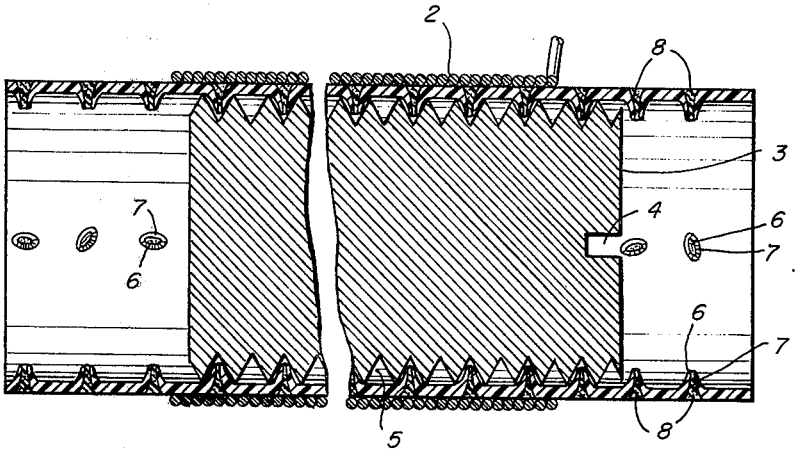
FIG. 2 is a cross sectional view taken along the line 2—2 of FIG. 1.

As illustrated in FIG. 2, the tunable element 3 is formed with threads 5 and has an outer diameter that preferably, in the absence of thread engaging means, provides a sliding fit with the inner diameter of the tubular member 1.

Figure 3:
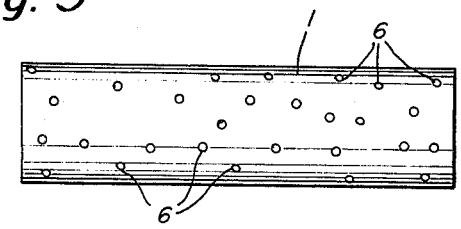
FIG. 3 is a side elevational view of a component of the invention in modified form.

Thread engaging means are formed on the inner surface of the tubular member 1 by means of a series of holes 6. These holes 6 may be uniformly arranged such as aligned longitudinal rows, as illustrated in FIG. 1, or alternately may be randomly dispersed over the surface of the tubular element, as illustrated in FIG. 3. The holes 6 may have a range of diameters, which in the specific example illustrated, may range from 0.005 to 0.020 inches in diameter. These holes permanently deform the inner surface of the tubular member about the holes inwardly to a depth sufficient to engage the threads 5 of the tuning element 3. Typically these holes permanently deform the wall of the tubular member 1 to a distance of from 0.010 to 0.015 inches. Thus the permanently deformed portion or segment of the wall about the holes 6 provide thread engaging means for tuning elements that have an outer diameter which is less than a sliding fit.

The holes 6 are preferably formed by piercing the tubular member 3 with a sharp instrument. These perforations are made prior to the application of the wire for insertion of the tuning element. The perforations permanently stretch and distort the film which forms the tubular member 3 beyond the elastic limit so that the wall of the tubular member cannot return to its original shape. This piercing action stretches the material and apparently causes transverse tears in the shape described and illustrated in the drawings. The elongated segment 7 provide additional thread engaging surfaces. These permanently deformed segments 7 readily engage the screw threads of the tuning element 3, thus providing a suitable means for permitting threading action of the tuning element 3 without longitudinal slippage, even when longitudinal forces are applied to the tuning element 3. The permanent deformation of the tubular member formed by the holes 6 significantly increases the frictional engagement of the wall with the screw threads, making it virtually impossible to push the screws longitudinally of the tubular member. It has also been found that the perforations or holes 6 do not affect electrical performance. It should be realized that the transverse tears may be shaped so as to engage almost entirely within the thread roots. They may be positioned so that a few of them do not engage in the thread roots but he majority do. By selecting the direction and angles and spacing of the tears, it is possible to control the push through force along with the rotational torque which is required to operate the device.

As noted above, the thickness of the tubular member 1 is in the order of two or three mils in most commercial products. These tubular members have a tolerance of ±0.0015 inches on the inner diameter. The threaded tuning element normally is maintained within tolerances of ±0.003 inches. Thus by providing deformed segments of sufficient depth, adequate interference may be provided between the deformed area and the threaded tuning element to permit adequate resistance to torque in a broad range of tolerances.

In a preferred form of the invention, the tube member 2 is coated with a low viscosity epoxy. The epoxy is then wiped from the surface of the tube leaving small deposits within the holes, as illustrated at 8. The quantity of epoxy, as illustrate at 8, fills the perforation of the holes to the inner end of the segments 7, presumably by capillary action. When the epoxy solidifies it provides a firm, solid but small protrusion within the tube.

It has been found that random arrangement, or even orderly arrangement, of the holes 6 frequently results in threads cutting across the segments 7 when the tuning element 3 is inserted. This action increases the effectiveness of the holes and segments in securing the threaded tuning element 6 within the tube 1. In such arrangements the threads cut through the epoxy filled segments defining a permanent internal thread within the tubing. This arrangement has several advantages. There is provided a long-lasting permanent thread with substantial resistance to longitudinal forces. In addition, the resistance to torque is typically increased. When epoxy is used to fill the holes the resistance to torque is typically increased by a factor of four. It has been found, for example, that if an axial force is applied to a threaded tuning element and it is forced all the way through the tubular member 1, having no epoxy in the holes, it takes one and one half pounds of force. When epoxy is placed in the holes of the same tubular member, the force required to push a threaded tuning element through increases 4 times to 5 pounds.

By using epoxy as a filler for the segments 7, the number of perforations also may be reduced while retaining the same effectiveness.

In some instances it may be desirable to eliminate the epoxy 1. Under these conditions the tuning element cuts thread through the segments 7. In this arrangement the perforations or segments 7 are more resilient, resulting in lower resistance to torque, if such is desired.

The present invention also permits the amount of torque required to move the threaded tuning element 3 longitudinally to be varied. This may be controlled, as noted above, by eliminating or including the epoxy filler or alternately by varying the number and diameter of the holes 6. The number of holes will also depend in some part upon the tolerances of the components. For example, where tolerances are close, fewer holes or perforations will be needed.

In the present invention it has also been found that the rotational life characteristics of the tubular member are extremely stable. In conventional prior art tubular members used for tunable inductors, there is substantially no resistance to torque applied to tuning elements after the tuning element has been threaded into and out of the tubular member five or ten times. In short, the tubular member loses its threading capacity. In the present invention, however, the torque required to turn the tuning element in the tubular member after more than twenty five cycles is reduced only approximately 10% of its original value. After 100 rotational life cycles, the typical torque has been reduced to approximately 50% of its original value, and there is still no play in the mechanism. The part is entirely useful even at these extended life circumstances. This highly superior torque characteristic permits the present invention to be used without any appreciable wear to the tuning mechanism for fixed tuned inductors.

It has also been found that the present invention is particularly suited for general use as a strip-proof nut for a threaded element. The tubular element 1 may also be designed as a screw retaining element or as a strip-proof nut. Thus, for example, the tubular element as illustrated in FIG. 3 may be formed with means on its outer surface to permit the tubular member to function as a strip-proof nut. For example, the tubular member 1 may be formed with a wall thickness sufficient to allow it to function as a nut. With this modification, the tubular member may function as a strip-proof nut. As such, the nut is essentially strip-proof. In tests heretofore conducted a threaded member having an outer diameter substantially equal to the inner diameter of the tubular member has been forced all the way through the tubular member. After forcing it through once, the threaded member still requires 85% of the original force to drive the threaded member through once more. This means the segments 7 still function as thread engaging means. In further tests the segments 7 still function after ten passes of a threaded member through the tubular member.

It should be understood that the foregoing description of the invention is intended merely to be illustrative thereof, and other modifications and embodiments may be apparent to those skilled in the art without departing from its spirit.

Having thus described the invention, what I desire to claim and secure by Letters Patent is:

1. A tunable inductor coil comprising, an elongated tubular member, a length of wire coaxial with and coiled about said tubular member, and a threaded tuning element extending lengthwise in said tubular member, said tubular member formed of a dielectric plastic material with a plurality of holes in the wall of said tubular member, each defining permanently deformed segments of said wall of said tubular member projecting inwardly thereof a distance sufficient to engage the threads of said threaded tuning element thereby providing thread engaging means.

2. A tunable inductor coil as set forth in claim 1 wherein said inwardly projecting segments are filled with a plastic material.

3. A tunable inductor as set forth in claim 2 wherein said tubular member has a wall thickness of from 0.001 to 0.010 inches.

4. A tunable inductor as set forth in claim 1 wherein said holes have a diameter of from 0.001 to 0.020 inches.

5. A tunable inductor as set forth in claim 1 wherein said deformed segments cover less than 20% of the inner surface of said tubular member.

* * * * *